US005775598A

United States Patent [19]

Takayama et al.

[11] Patent Number: 5,775,598

[45] Date of Patent: Jul. 7, 1998

[54] ROTARY ATOMIZING HEAD TYPE COATING MACHINE

[75] Inventors: Shinichi Takayama; Takehito Katsunuma, both of Tokyo, Japan

[73] Assignee: ABB Industry K.K., Tokyo, Japan

[21] Appl. No.: 737,934

[22] PCT Filed: Apr. 5, 1996

[86] PCT No.: PCT/JP96/00929

§ 371 Date: Dec. 3, 1996

§ 102(e) Date: Dec. 3, 1996

[87] PCT Pub. No.: WO96/31286

PCT Pub. Date: Oct. 10, 1996

[30] Foreign Application Priority Data

Apr. 6, 1995 [JP] Japan ..... 7-106840
Apr. 6, 1995 [JP] Japan ..... 7-106841

[51] Int. Cl.[6] ..... B05B 17/00

[52] U.S. Cl. ..... 239/703; 239/707

[58] Field of Search ..... 239/222.11, 223, 239/224, 691, 699, 700, 703, 704, 706, 707, 708

[56] References Cited

U.S. PATENT DOCUMENTS

| | | | |
|---|---|---|---|
| 2,784,114 | 3/1957 | Miller | 239/223 X |
| 2,955,565 | 10/1960 | Schotland . | |
| 3,009,441 | 11/1961 | Juvinall | 239/703 X |
| 3,010,428 | 11/1961 | Sedlacsik . | |
| 3,021,077 | 2/1962 | Gauthier . | |
| 3,072,341 | 1/1963 | Point et al. . | |
| 3,075,706 | 1/1963 | Point . | |
| 3,083,121 | 3/1963 | Gauthier . | |
| 3,128,045 | 4/1964 | Gauthier . | |
| 3,279,429 | 10/1966 | Felici et al. . | |
| 3,554,445 | 1/1971 | Engwall | 239/706 |
| 3,826,425 | 7/1974 | Scharfenberger et al. . | |
| 4,228,961 | 10/1980 | Itoh | 239/707 X |
| 4,887,770 | 12/1989 | Wacker et al. . | |
| 5,433,387 | 7/1995 | Howe et al. . | |
| 5,474,236 | 12/1995 | Davis et al. | 239/703 |

FOREIGN PATENT DOCUMENTS

| | | |
|---|---|---|
| 55-034130 | 3/1980 | Japan . |
| 2 237667 | 9/1990 | Japan . |
| 6 210205 | 8/1994 | Japan . |
| 6 269701 | 9/1994 | Japan . |

*Primary Examiner*—Andres Kashnikow
*Assistant Examiner*—Steven J. Ganey
*Attorney, Agent, or Firm*—Oblon, Spivak, McClelland, Maier & Neustadt, P.C.

[57] ABSTRACT

In a rotary atomizing head type coating machine, paint mist is prevented from depositing on a shaping air ring and synthetic resin cover. Shaping air ring includes an inner ring of a metallic material, an outer ring of an insulating synthetic resin material, and a shaping air outlet hole provided at the fore ends of the two rings. The inner ring has its base end electrically connected to an air motor, and provides an annular repulsion electrode at its fore end. This annular repulsion electrode induces strong positive discharges, thereby attracting clouds of negative ions, and preventing paint deposition on and contamination of the shaping air ring by a phenomenon of homopolar repulsions between clouds of negative ions and negatively charged paint particles.

20 Claims, 14 Drawing Sheets

ROTARY ATOMIZING HEAD TYPE COATING MACHINE

BACKGROUND OF THE INVENTION

1. Field of the Invention

This invention relates to a rotary atomizing head type coating machine with an indirect charging system, which is particularly suitable for use with low resistance paints such as water-base paints and metallic paints.

2. Discussion of the Background

Generally, in a rotary atomizing head type coating machine, while a rotary atomizing head is put in high speed rotation, a high voltage is applied across the atomizing head and an object to be coated, and a paint is supplied to the rotary atomizing head to undergo atomization and charging there. Atomized and charged paint particles are caused to fly along an electrostatic field toward a coating object, which is located axially forward of the atomizing head, and deposit on the coating object.

In this regard, illustrated in FIG. 11 is a prior art rotary atomizing head type coating machine employing an indirect charging system.

In that figure, indicated at 1 is a coating machine body which is mounted on a reciprocator (not shown). Provided internally of the coating machine body 1 is an air motor 2 of metallic material consisting of an air bearing 2A and a drive section 2B, along with valve devices (not shown) including a paint valve and a dump valve. Circumferentially, the coating machine body 1 is enshrouded under a synthetic resin cover 3. The air motor 2 is grounded through a cable 2C. The above-mentioned synthetic resin cover 3 is formed of an insulating synthetic resin material such as polyethylene terephthalate (PET), polyacetal (POM), polyamide (PA), polyethylene (PE), polypropyrene (PP) or the like.

Indicated at 4 is a rotational shaft of metallic material, which is rotatably supported in the air bearing 2A of the air motor 2. The fore end of the rotational shaft 4 is projected out of the coating machine body 1, while its base end is coupled with the drive section 2B of the air motor 2, thereby driving for high speed rotation.

Denoted at 5 is a bell type rotary atomizing head of metallic material which is provided at the fore end of the rotational shaft 4, the rotary atomizing head 5 having a cup-shaped circumferential surface 5A, an inner paint smoothing surface 5B and a paint releasing edge 5C.

Indicated at 6 is a center feed type paint supply pipe which is passed internally of the rotational shaft 4, the paint supply pipe 6 having its fore end extended into the rotary atomizing head 5 and connected at its base end to a paint valve which is in communication with a paint tank through a paint pipe (both not shown).

The reference numeral 7 indicates a shaping air ring which is threaded on a fore end portion of the synthetic resin cover 3 on the front side of the coating machine body 1. This shaping air ring 7 is located at the fore end of the coating machine body 1 in a position on the rear side of the rotary atomizing head 5 in such a way as to circumvent the circumferential surfaces 5A of the atomizing head 5.

In this instance, the shaping air ring 7 is constituted by an inner ring 8 which is formed of an insulating synthetic resin material, and an outer ring 9 likewise of an insulating synthetic resin material which is positioned around the outer periphery of the inner ring 8. Formed between the inner and outer rings is an air outlet 10 in the form of an annular gap through which shaping air is spurted out as indicated by arrow A to generate air flows. By attaching the outer ring 9 to the synthetic resin cover 3, the inner ring 8 can be fixed in position and electrically in contact with the air motor 2. For example, the inner ring 8 and outer ring 9 are formed of insulating synthetic resin material such as polyether sulfone (PES), polyphenylene sulfide (PPS), polyether imide (PEI), polyether ether ketone (PEEK) or the like.

Indicated at 11 are six external electrodes (only two electrodes are shown in the drawings) which are located in equidistant spaced positions, radially outward of the synthetic resin cover 3 and rearward of the paint releasing edges 5C of the rotary atomizing head 5. These external electrodes 11 are applied with a high voltage (e.g., −60 kV to −90 kV) from an external high voltage generator (not shown) to charge paint particles to be sprayed from the paint releasing edges 5C of the above-described rotary atomizing head 5.

Since the air motor 2 is grounded through the cable 2C, the air motor 2, rotational shaft 4 and rotary atomizing head 5, which are all formed of a metallic material, are maintained at the same earth potential.

With a paint coating machine having a rotary atomizing head arranged as described above, upon applying a high voltage to the respective external electrodes 11, electrostatic fields are formed by electric lines of force between each one of the external electrodes 11 and the rotary atomizing head 5 and at the same time between each one of the external electrodes 11 and a coating object (not shown). Besides, under the influence of a high voltage of −60 kV to −90 kV which is applied to the respective external electrodes 11, an ionization zone is formed in the vicinity of the fore end of each external electrode.

In this state, the rotational shaft 4 and rotary atomizing head 5 are put in high speed rotation by the air motor 2 on the coating machine body 1, and the paint valve is opened to supply a paint to the rotary atomizing head 5 through the paint supply pipe 6. The paint which has been fed to the rotary atomizing head 5 is spread into a thin film-like shape on the paint smoothing surface 5B under the influence of the centrifugal force resulting from the rotation. The liquid paint film is split into liquid threads as it is thrown radially outward from the paint releasing edges 5C, and the liquid threads are eventually broken and atomized into fine particle.

In the ionizing zones which are formed forward of the respective external electrodes, atomized paint particles are charged with high voltage, and the resulting charged paint particles are urged to fly toward the coating object which is connected to the ground, and deposit on the surfaces of the coating object.

Since the rotary atomizing head 5 is in high speed rotation, paint particles which are thrown out from the paint releasing edges 5C tend to fly in radially outward directions under the influence of the centrifugal force. However, by the action of shaping air which is spurted out in the direction of arrow A from the air outlet 10, paint particles off the paint releasing edge 5C of the rotary atomizing head 5 are shaped into a forwardly converging pattern.

In the case of the coating machine with the rotary atomizing head as described above, the coating machine body 1 is prevented from being contaminated with negatively charged paint particles by covering the machine body 1, except the rotary atomizing head 5, with an insulating synthetic resin material like the shaping air ring 7 and synthetic resin cover 3. More specifically, when a high voltage is applied to the respective external electrodes 11, the component parts of synthetic resin material including the shaping air ring 7 and the resin cover 3 are negatively charged under the influence of negative ions generated by the external electrodes 11. Consequently, due to a phenomenon of homopolar repulsions, negative ions charged on the shaping air ring 7 and resin cover 3 repel and keep the negatively charged paint particles from depositing on the surfaces of the cover 3 and ring 7.

However, actual paint coating operations invariably face a problem of contamination of the shaping air ring 7, developing gradually after starting a coating operation by applying a high voltage to the external electrodes 11 and putting the rotary atomizing head 5 in high speed rotation, because paint particles P in floating mist deposit on the shaping air ring 7 increasingly with the time of paint coating operation, namely, increasingly as the time of coating operation lapses 5 minutes (FIG. 12), 10 minutes (FIG. 13) and 15 minutes (FIG. 14).

Studying the mechanisms of contamination by charged paint particles, particularly from relations in potential between the rotary atomizing head 5 and the shaping air ring 7, it is worthwhile to note that the shaping air ring 7 of insulating synthetic resin material is simply held in contact, through that synthetic resin material, with the air motor 2 which is connected to the ground. In contrast, the rotary atomizing head 5 is directly connected to the ground through the rotational shaft 4 and air motor 2 of metallic material. Therefore, looking at the potential relations from the side of the external electrodes 11 which are applied with a high negative voltage, the shaping air ring 7 is electrically more closer to the positive side than the rotary atomizing head 5 which is connected to the ground.

For these reasons, a greater potential difference occurs between the rotary atomizing head 5 and the respective external electrodes 11 than between the shaping air ring 7 and the respective external electrodes 11. Accordingly, it is considered that greater and stronger positive discharges occur at the paint releasing edges 5C of the rotary atomizing head 5, while smaller and weaker positive discharges occur at the fore end of the shaping air ring 7.

As a consequence, negative ions generated by the respective external electrodes 11 are pulled toward the positive discharges as if attracted by the rotary atomizing head 5 and the shaping air ring 7, and larger and thicker clouds of negative ions occur at the paint releasing edges 5C while smaller and thinner clouds of negative ions appear at the fore end of the shaping air ring 7. In addition, taking into account the extremely small positive discharges and the existence of blasts of shaping air coming out of the shaping air ring 7, it is presumable that the clouds at the fore end of the shaping air ring 7 are extremely lean.

Under these circumstances, paint particles sprayed from the paint releasing edges 5C of the rotary atomizing head 5 are negatively charged while being passage through the ionization zones of the external electrodes 11, and the charged paint particles are urged to fly toward and deposit on a coating object which is at the earth potential (with a tendency toward the positive when looked at from the side of the external electrodes 11). However, a part of paint particles are urged to flow in a forward direction from behind the shaping air ring 7 entrained on air vortices generated by rotation of the rotary atomizing head 5. At this time, negative ions around the fore end of the air shaping ring 7 are lessened and leaned out by the occurrence of weak positive discharges as mentioned hereinbefore. Therefore, it is assumed that floating paint particles (paint mist) which have been negatively charged by the external electrodes 11 are attracted toward the positive discharges instead of being repelled by negative ions, and deposit on and contaminate fore end portions of the air shaping ring 7.

Further, contamination of the shaping air ring 7 by deposition of the paint P occurs progressively in a pattern as shown in FIGS. 12 to 14. As clear from these figures, the shaping air ring 7 undergoes contamination in a more conspicuous degree especially in those areas between the lines (indicated by one-dot chain lines) connecting the center of the rotary atomizing head 5 with the respective external electrodes 11. Taking into consideration the positional relations with the six external electrodes 11, the reason for this seems to be that positive discharges occur in a greater degree on the lines connecting the center of the rotary atomizing head 5 with the respective external electrodes 11 than between these lines. This can be explained by the fact that the contamination by paint P occurs initially between outer ends of these lines and spread in radially outward directions toward the synthetic resin cover 3.

SUMMARY OF THE INVENTION

In view of the above-discussed problems with the prior art, it is an object of the present invention to provide a rotary atomizing head type coating machine, which can prevent contamination of a shaping air ring of the rotary atomizing head by a paint.

In accordance with the present invention, for achieving the above-stated objective, there is provided a rotary atomizing head type coating machine basically including a coating machine body circumferentially enshrouded under a synthetic resin cover, an air motor provided within the coating machine body and grounded to the earth potential, a rotary atomizing head provided at the fore end of the coating machine body and coupled with the air motor, the rotary atomizing head being terminated with paint releasing edges at the fore end thereof, a shaping air ring provided at the fore end of the coating machine body in such a way as to circumvent the outer periphery of the rotary atomizing head and having an air outlet to spurt shaping air from behind the paint releasing edges of the rotary atomizing head, and external electrodes positioned radially on the outer side of the coating machine body and externally applied with a high voltage to charge paint particles sprayed from the paint releasing edges of the rotary atomizing head, characterized in that at least part of the shaping air ring is formed of a conductive material and electrically connected to the air motor, and an annular repulsion electrode is formed at least in part of the conductive material.

With the arrangements just described, the annular repulsion electrode is directly connected to the ground through the air motor, so that stronger positive discharges occur at the annular repulsion electrode than at the paint releasing edges. As a consequence, clouds of negative ions which are generated by the external electrodes are pulled toward stronger positive discharges on the side of the shaping air ring, preventing deposition of paint particles on the air shaping ring by the phenomenon of homopolar repulsions which occur between the negatively charged paint particles and clouds of negative ions.

In this instance, the shaping air ring may be constituted by an inner ring formed of a conductive material and electrically connected to the air motor, an outer ring formed of an insulating synthetic resin material and positioned in such a way as to enshroud the outer periphery of the inner ring, and an air outlet formed and defined between the inner and outer rings, the above-mentioned annular repulsion electrode being constituted by a fore end portion of the inner ring.

Alternatively, the air shaping ring may be constituted by a ring body formed of an insulating synthetic resin material and having an air outlet at the fore end thereof, a conductive ring formed on the inner periphery of the shaping air ring by means of a conductive material and electrically connected to the air motor, the above-mentioned annular repulsion electrode being constituted by a fore end portion of the conductive ring.

Further, the shaping air ring may be constituted by a ring body formed of an insulating synthetic resin material and having an air outlet on a flat front face thereof, a conductive ring formed on the inner periphery of the shaping air ring body by the use of a conductive material and electrically connected to the air motor, and an annular repulsion electrode formed on the front face of the shaping air ring by a separate member from the conductive ring and electrically connected to the conductive ring.

By arranging the shaping air ring of the present invention in various specific forms as described above, clouds of negative ions pulled toward the annular repulsion electrode can be carried forward toward the outer periphery of the rotary atomizing head by shaping air spurted from the respective air outlets, contributing to facilitate the negative charging of paint particles which are released from the paint releasing edges of the rotary atomizing head.

Further, a conductive metal may be used as the conductive material which constitutes the above-described annular repulsion electrode.

Alternatively, a conductive synthetic resin material may be used as the conductive material which constitutes the annular repulsion electrode if desired.

On the other hand, the shaping air ring according to the present invention may be of an insulating synthetic resin material, and provided with a conductive film layer formed on the inner periphery of the shaping air ring and electrically connected to the air motor, and an annular repulsion electrode constituted by at least part of the conductive film layer.

In this instance, the shaping air ring may be constituted by an inner ring formed of an insulating synthetic resin material, an outer ring formed of an insulating synthetic resin material and positioned in such a way as to cover the circumference of the inner ring, an air outlet formed between the inner and outer rings, a conductive film layer coated with a conductive paint on the inner periphery of the inner ring, and an annular repulsion electrode constituted by a fore end portion of the conductive film layer.

In an alternative form, the shaping air ring is constituted by a ring body formed of an insulating synthetic resin material and having air outlets on a flat front face thereof, a conductive film layer coated with a conductive paint on the inner periphery and extended to the flat front face of the shaping air ring body, and an annular repulsion electrode constituted by a fore end portion of the conductive film layer.

On the other hand, according to the present invention, the above-described annular repulsion electrode can be formed as an annular ring-like body which circumvents circumferential surfaces of the rotary atomizing head in the vicinity thereof.

DISCUSSION OF THE PREFERRED EMBODIMENTS

Figure 1:
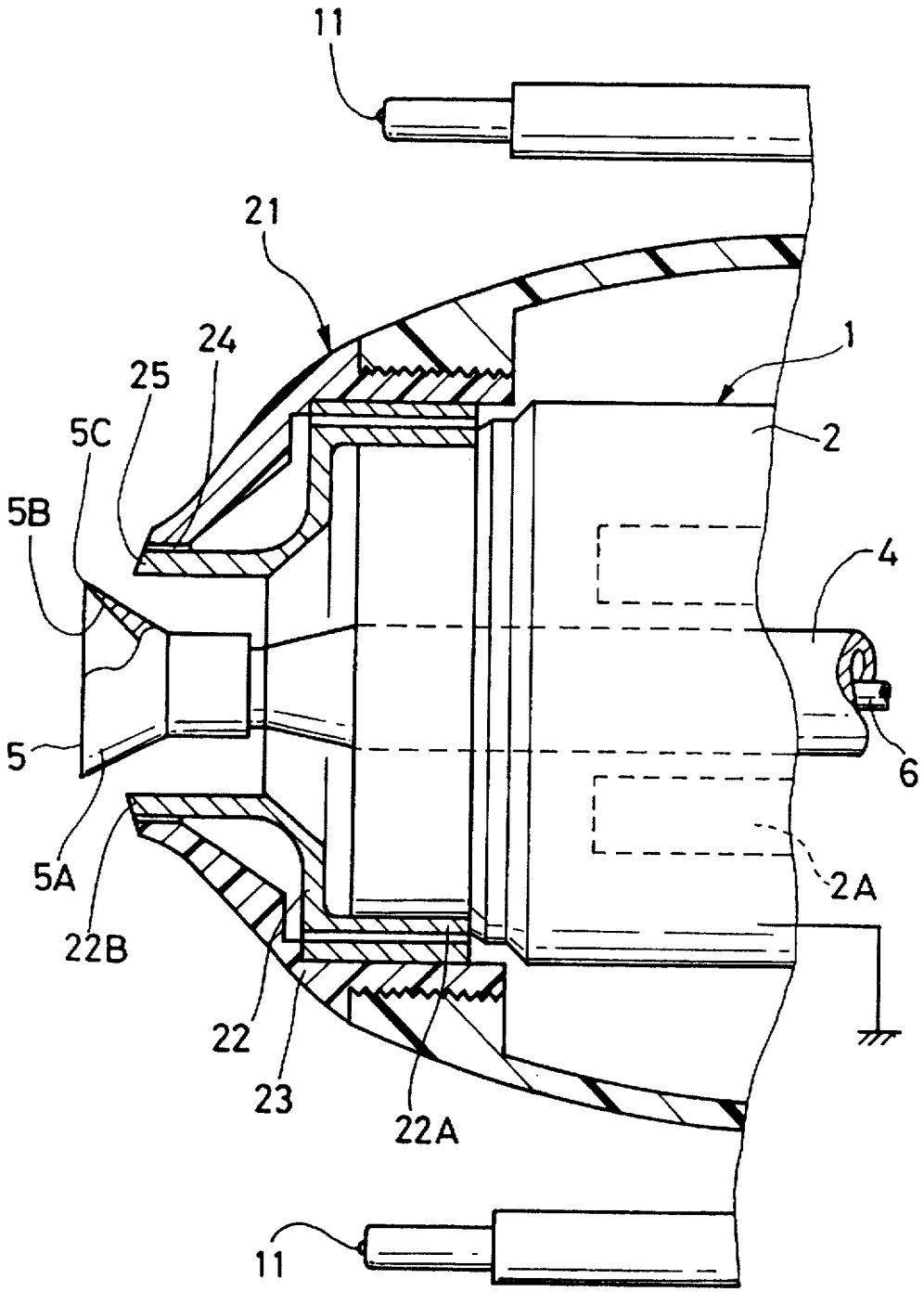
FIG. 1 is a vertical section through major components of a rotary atomizing head type coating machine adopted as a first embodiment of the invention.

Hereafter, the present invention is described more particularly by way of its preferred embodiments with reference to FIGS. 1 through 10. In the following description of preferred embodiments, those component parts which are common with the above-described prior art counterpart are simply designated by common reference numerals or characters without repeating same explanations.

Figure 2:
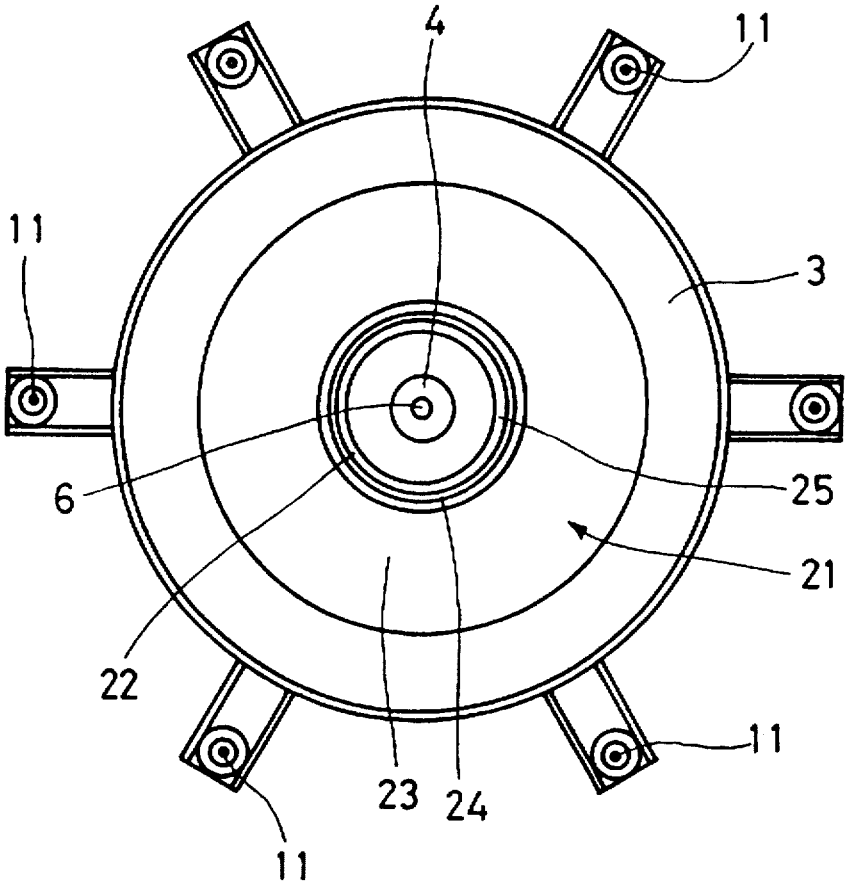
FIG. 2 is a schematic front view of the coating machine of the first embodiment, with a rotary atomizing head assembly removed.

Referring first to FIGS. 1 and 2, there is shown a first embodiment of the present invention.

In these figures, indicated at 21 is a shaping air ring which is threaded on a fore end portion of a synthetic resin cover 3 at the fore end of a coating machine body 1 proper. Namely, in place of the shaping air ring 7 of the prior art described hereinbefore, the shaping air ring 21 is provided at the fore end of the coating machine body 1 at a position behind a rotary atomizing head 5 in such a manner as to circumvent the circumferential surfaces 5A of the latter.

In this case, the shaping air ring 21 is constituted by an inner ring 22 which is formed of a conductive material, for example, a metallic material such as copper, stainless steel, aluminum or the like, an outer ring 23 which is positioned to circumvent the outer periphery of the inner ring 22 and formed of an insulating synthetic resin material such as, for example, polyether sulfone (PES), polyphenylene sulfide (PPS), polyether imide (PEI), polyether ether ketone (PEEK) or the like, and an annular air outlet 24 located at the fore ends of the inner and outer rings 23 to spurt shaping air toward the outer periphery of the rotary atomizing head 5. The inner ring 22 has its base end 22A held in contact with and electrically connected to the outer periphery of the air motor 2, which is grounded to the earth.

Denoted at 25 is an annular repulsion electrode which is provided at a fore end portion 22B of the inner ring 22. This annular repulsion electrode 25 is formed in a ring-like form integrally with the inner ring 22 and located closely around circumferential surfaces 5A of the rotary atomizing head 5.

In paint coating operations, the rotary atomizing head type coating machine of this embodiment, using the arrangements just described, operates in the same manner as the prior art counterpart described hereinbefore.

According to this embodiment of the invention, however, the inner ring 22 of the shaping air ring 21 is formed of a metallic material, and its base end 22A can be directly connected to the ground through the air motor 2, forming the annular repulsion electrode 25 at its fore end 22B. On the other hand, as mentioned hereinbefore in connection with the prior art, the rotary atomizing head 5 of a metallic material is also directly grounded to the earth through the air motor 2, so that the annular repulsion electrode 25 of the shaping air ring 21 and the rotary atomizing head 5 remain at the same potential (at the earth potential).

Besides, since the external electrodes 11 are positioned rearward of the paint releasing edges 5C of the rotary atomizing head 5, the distance from the external electrodes 11 to the annular repulsion electrode 25 is shorter than the distance from the external electrodes 11 to the paint releasing edges 5C of the rotary atomizing head 5. Therefore, positive discharges occur in a greater degree at the annular repulsion electrode 25, which is located closer to the external electrodes 11, than at the paint releasing edge 5C which is more distant from the external electrodes 11. As a result, clouds of negative ions generated by the respective external electrodes 11 are pulled toward the annular repulsion electrode 25 because of the stronger positive discharges, and tend to linger in the vicinity of the annular repulsion electrode 25 in enlarged and thickened state.

Accordingly, paint particles which have been released from the paint releasing edges 5C of the rotary atomizing head 5 and negatively charged by the high voltage external electrodes 11, are securely kept from depositing on the shaping air ring 21 by homopolar repulsions occurring between negatively charged paint particles and the clouds of negative ions.

Further, in this case, the shaping air ring 21 which has the inner ring 22 surrounded by the outer ring 23 of an insulating synthetic resin material can secure a sufficient insulation distance between the inner ring 22 and each one of the external electrodes 11, thereby preventing shortcircuiting between the annular repulsion electrode 25 of the shaping air ring 21 and the external electrodes 11, and guaranteeing high safety by suppressing positive discharges at the annular repulsion electrode 25.

Furthermore, along with shaping air which is spurted out from the air outlet hole 24 of the shaping air ring 21, a large quantity of negative ions which have been pulled toward and around the annular repulsion electrode 25 can be carried forward toward the outer periphery of the rotary atomizing head 5. Accordingly, paint particles released from the paint is releasing edges 5C of the rotary atomizing head 5 can be effectively charged by the forwardly carried negative ions in such a manner as to enhance the paint deposition efficiency on a coating object.

As described above, the shaping air ring 21 of this embodiment uses the inner ring 22 of metallic material, forming the annular repulsion electrode 25 at the fore end thereof. The annular repulsion electrode 25 which is located at the fore end of the shaping air ring 21 is capable of inducing strong positive discharges to attract clouds of negative ions thereto, so that mist of paint particles is securely prevented from depositing on the shaping air ring 21 and resin cover 3 by homopolar repulsions occurring between negative ion clouds and negatively charged paint particles.

Figure 3:
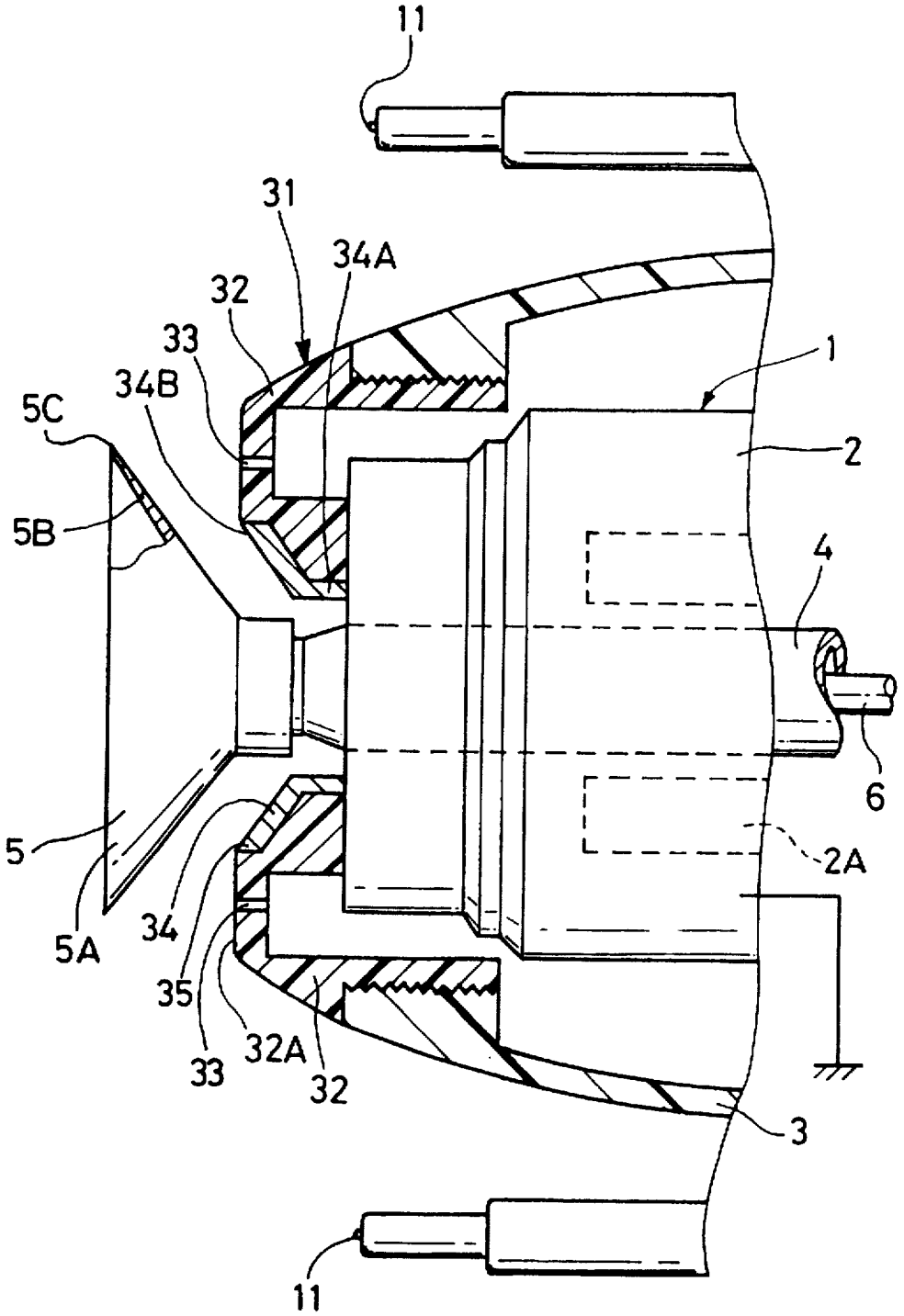
FIG. 3 is a vertical section through major components of a rotary atomizing head type coating machine adopted as a second embodiment of the invention.
Figure 4:
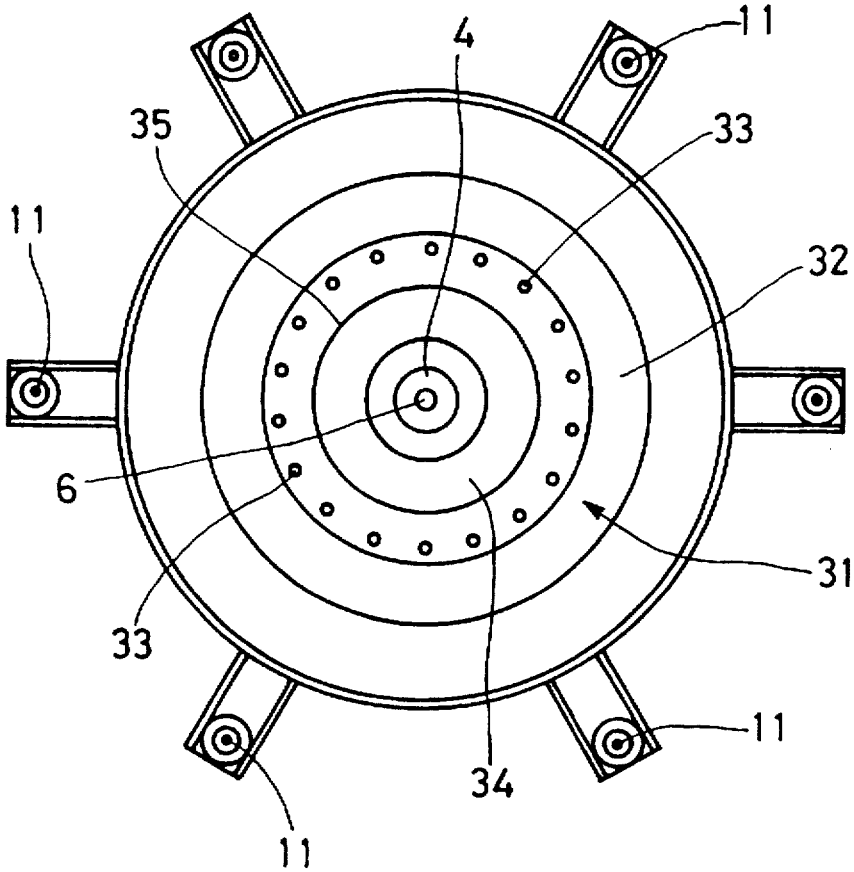
FIG. 4 is a schematic front view of the coating machine of the second embodiment, with a rotary atomizing head assembly removed.

Referring now to FIGS. 3 and 4, there is shown a second embodiment of the present invention, which is characterized in that the shaping air ring is constituted by a single ring structure and provided with a plural number of air outlet holes at its fore end, and in that an annular repulsion electrode is formed at the fore end of a conductive ring which is fitted on the inner periphery of the shaping air ring. In the following description of the second embodiment, those component parts which are common with the foregoing first embodiment are simply designated by common reference numerals or characters without repeating same explanations.

In these figures, indicated at 31 is a shaping air ring which is employed in this embodiment in place of the shaping air ring 21 of the first embodiment. The shaping air ring 31 is mounted in position at the fore end of the coating machine body 1, in threaded engagement with a fore end portion of the synthetic resin cover 3 at the fore end of the coating machine body 1 in such a manner as to circumvent circumferential surfaces 5A at a position rearward of the rotary atomizing head 5.

The shaping air ring 31 includes a ring body 32 substantially of J-shape in section with a flat front face 32A, which is formed of an insulating synthetic resin material such as, for example, polyether sulfone (PES), polyphenylene sulfide (PPS), polyether imide (PEI), polyether ether ketone (PEEK) or the like, and a plural number of air outlet holes 33 which are arranged circularly on the flat front face 32A of the ring body 32 to spurt shaping air toward the outer periphery of the rotary atomizing head 5.

Indicated at 34 is a conductive ring which is integrally cast on the inner periphery of the ring body 32 by the use of a metallic conductive material such as copper, stainless steel, aluminum or the like. The conductive ring 34 has its base end 34A electrically conductively in contact with the outer periphery of the air motor 2, and has its fore end 34B extended up to the front end face 32A of the shaping air ring 31.

Denoted at 35 is an annular repulsion electrode which is provided in a fore end portion 34B of the conductive ring 34 of the shaping air ring 31, the annular repulsion electrode 35 being formed integrally with the conductive ring 34 in such a way as to circumvent the circumferential surfaces 5A of the rotary atomizing head 5 in the vicinity thereof.

According to the present embodiment with the arrangements just described, the shaping air ring 31 on the rotary atomizing head type coating machine induces stronger positive discharges at the annular repulsion electrode 35 than at the paint releasing edges 5C of the rotary atomizing head 5, substantially in the same manner as in the foregoing first embodiment. As a consequence, clouds of negative ions are enlarged and thickened as they are pulled toward the positive discharges at the annular repulsion electrode 35, preventing deposition of charged paint particles on the shaping air ring 31 by homopolar repulsions between clouds of negative ions and negatively charged paint particles.

Further, by shaping air which is spurted out through the shaping air outlets 33, clouds of negative ions are moved forward toward the outer periphery of the rotary atomizing head 5 to charge of atomized paint particles and therefore to enhancement of the paint deposition efficiency on a coating object.

Figure 5:
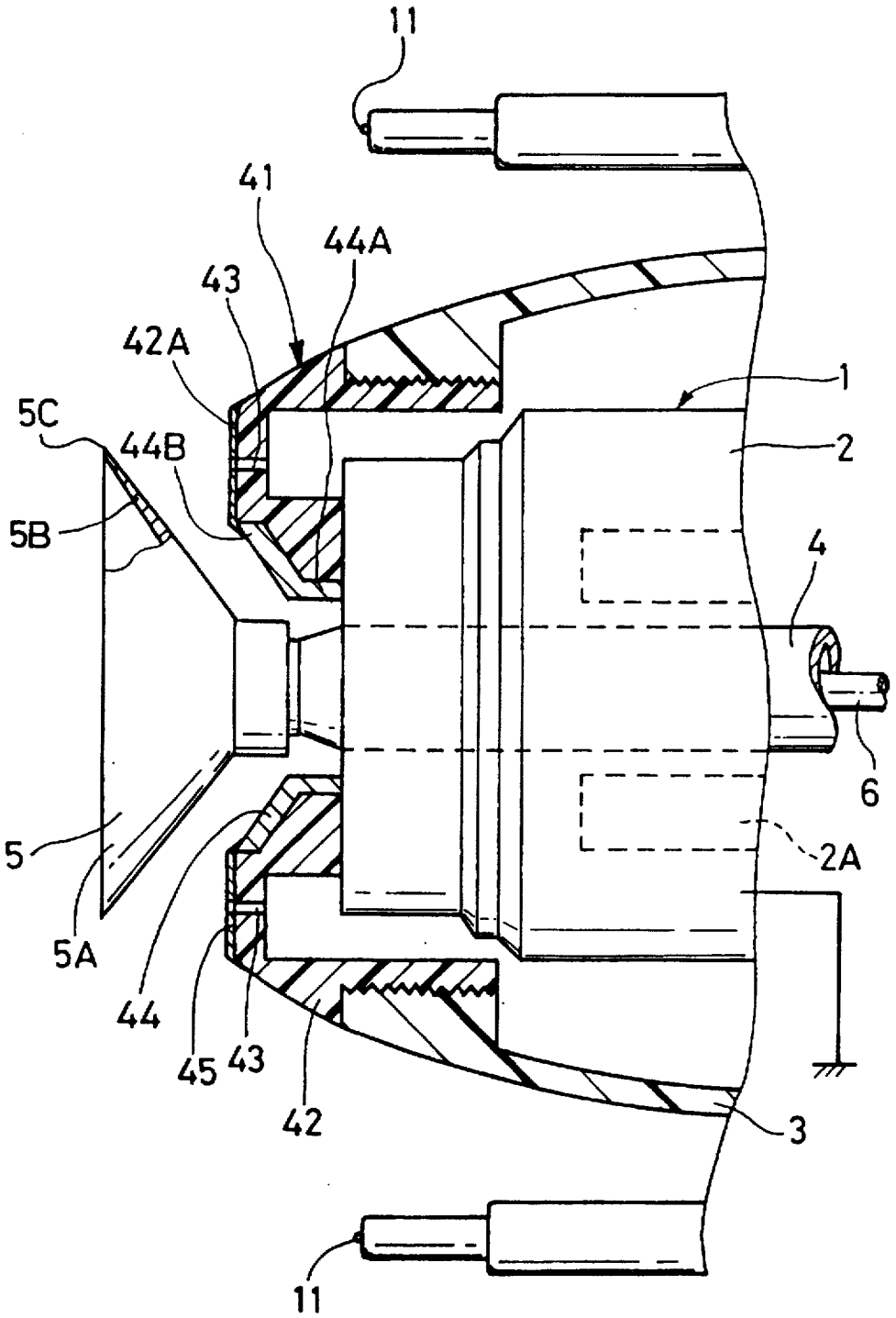
FIG. 5 is a vertical section through major components of a rotary atomizing head type coating machine adopted as a third embodiment of the invention.

Illustrated in FIG. 5 is a third embodiment of the invention, which is characterized in that the shaping air ring is constituted by a single integral ring structure with air outlet holes on a front face thereof, a conductive ring is provided on the inner periphery of the shaping air ring, and an annular repulsion electrode is provided on the front face by fixing thereon a separate member which is electrically connected to the conductive ring. In the following description of the third embodiment, those component parts common with the foregoing first embodiment are simply designated by common reference numerals or characters without repeating similar explanations.

In that figure, indicated at 41 is the shaping air ring which is used in the third embodiment. This shaping air ring 41 is constituted by a ring body 42 substantially of a J-shape in section having a flat front face 42A, which is formed of an insulating synthetic resin material similar to that of the shaping air ring 31 of the second embodiment, and a plural number of air outlet holes 43 which are arranged circularly on the front face 42A for spurting shaping air toward circumferential surfaces of the rotary atomizing head 5.

Denoted at 44 is a conductive ring which is integrally cast on the inner periphery of the ring body 42 by the use of a metallic conductive material such as, for example, copper, stainless steel, aluminum or the like. The conductive ring 44 has its base end 44A held in contact with the outer periphery of the air motor 2 for electrical conduction therethrough.

Indicated at 45 is an annular repulsion electrode which is constituted by a member separate from the conductive ring 44 and fixed on the front face 42A of the ring body 42. This annular repulsion electrode 45 is in the form of a flat ring-like plate and located to circumvent the circumferential surfaces 5A of the rotary atomizing head 5 in the vicinity thereof. Further, the annular repulsion electrode 45 is connected to a fore end portion 44B of the conductive ring 44, that is to say, connected through the conductive ring 44 to the air motor 2 which is maintained at the earth potential.

According to the present embodiment with the arrangements just described, the shaping air ring 41 can produce the same operational effects as the counterpart in the foregoing second embodiment. Besides, since the annular repulsion electrode 45 is more positively provided on the front face 42A of the ring body 42 electrically in contact with the conductive ring 44, the annular repulsion electrode 45 has a broader surface area which is capable of generating stronger positive discharges for the purpose of suppressing deposition of paint particles on the shaping air ring 41 all the more.

Figure 6:
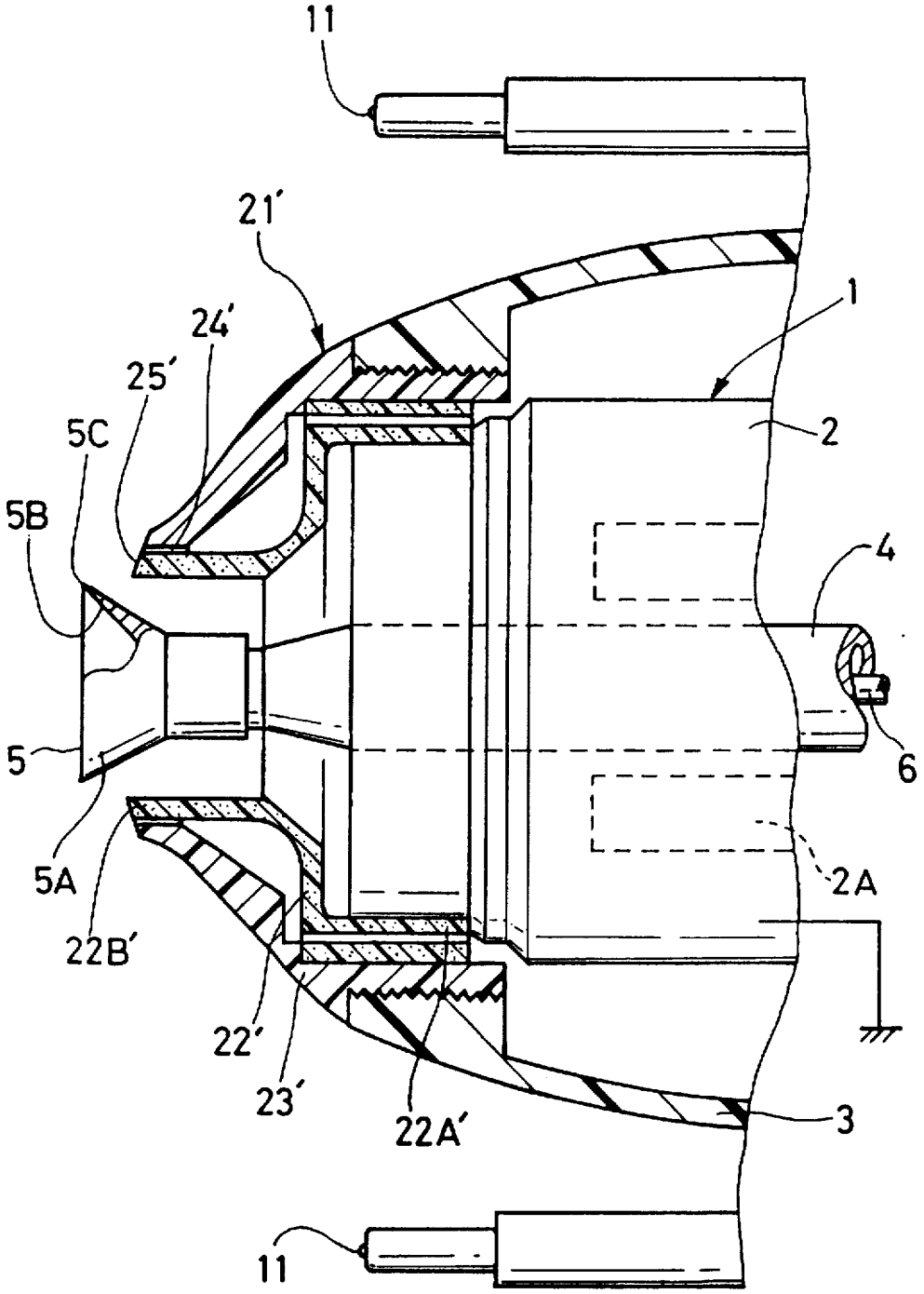
FIG. 6 is a vertical section through major components of a rotary atomizing head type coating machine adopted as a fourth embodiment of the invention.
Figure 7:
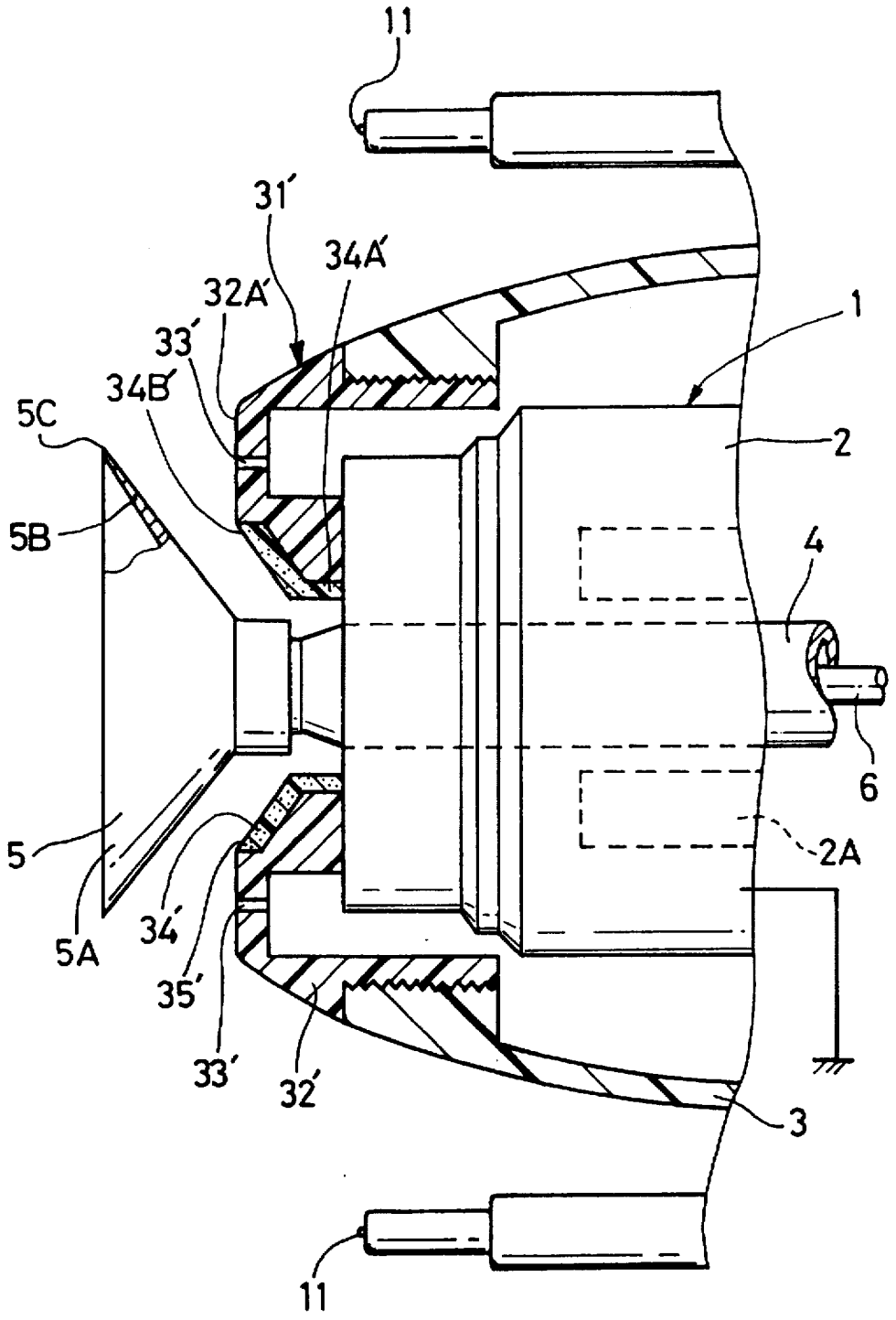
FIG. 7 is a vertical section through major components of a rotary atomizing head type coating machine adopted as a fifth embodiment of the invention.
Figure 8:
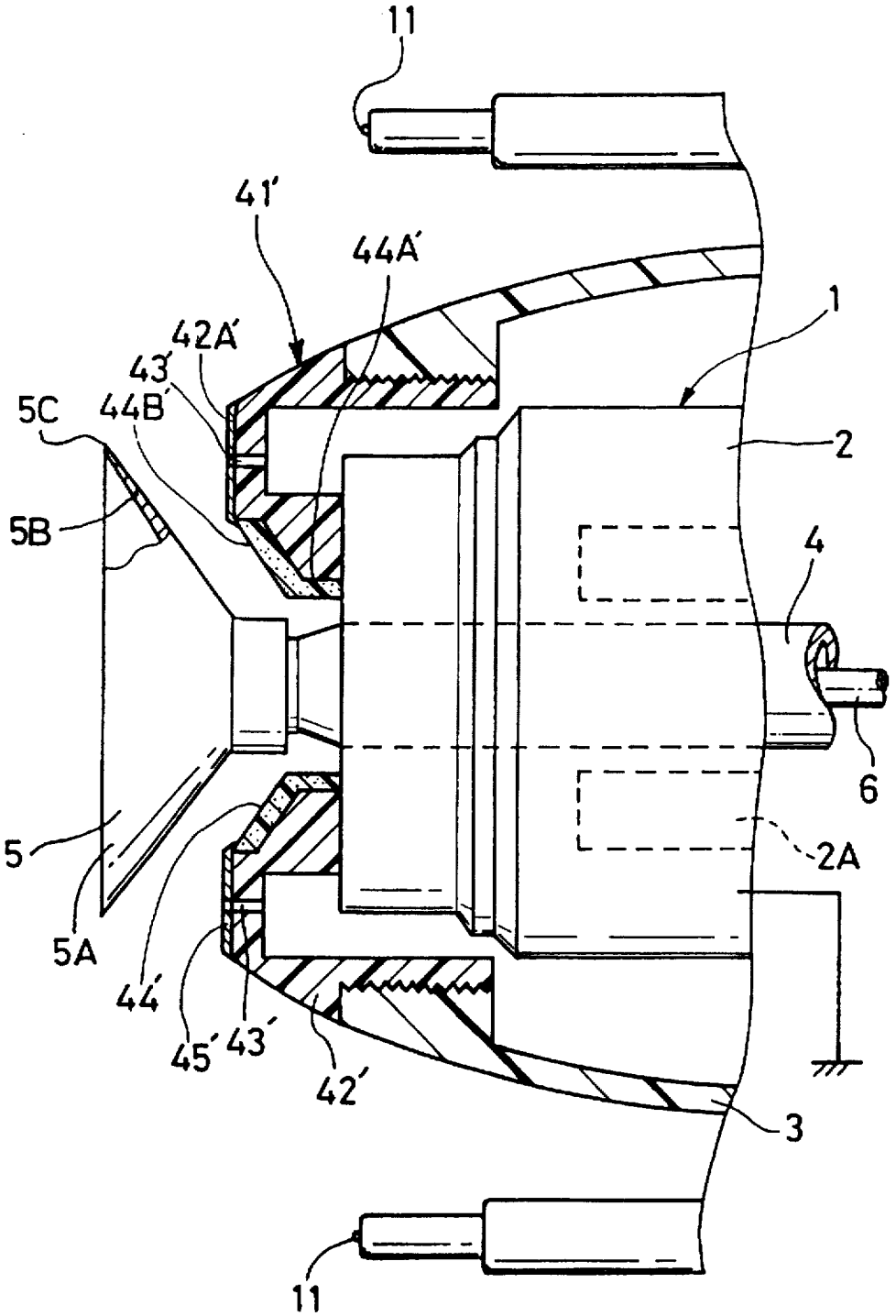
FIG. 8 is a vertical section through major components of a rotary atomizing head type coating machine adopted as a sixth embodiment of the invention.

On the other hand, shown in FIGS. 6 to 8 are fourth, fifth and sixth embodiments of the present invention. In the following descriptions of the fourth to sixth embodiments, those components which have corresponding counterparts in the foregoing first to third embodiments are designated by corresponding reference numerals or characters each attached with an apostrophe (').

The fourth embodiment shown in FIG. 6 uses a shaping air ring 21' which is formed with an inner ring 22' of a conductive synthetic resin material in place of the inner ring 22 of the shaping air ring 21 in the above-described first embodiment. The inner ring 22' has its base end 22A' held in contact with and electrically connected to the outer periphery of the air motor 2, while forming an annular repulsion electrode 25' at its fore end portion 22B'.

In this instance, instead of a metallic material, the inner ring 22' is formed of a conductive synthetic resin material which is imparted with conductivity by mixing metal fiber or powder into a synthetic resin material of the sort as mentioned hereinbefore.

The fifth embodiment shown in FIG. 7 uses a shaping air ring 31' with a conductive ring 34' of a conductive synthetic resin material in place of the metallic conductive ring 34 provided on the shaping air ring 31 of the foregoing second embodiment.

Further, the sixth embodiment shown in FIG. 8 uses a shaping air ring 41' with a conductive ring 44 of a conductive synthetic resin material in place of the metallic conductive ring 44 provided on the air shaping ring 41 of the foregoing third embodiment.

According to the fourth to sixth embodiments with the arrangements just described, the shaping air rings 21', 31' and 41' can produce substantially the same operational effects as in the foregoing first to third embodiments. In addition, the shaping air rings 21', 31' and 41' which are constituted by a molded structure of a mixture of insulating and conductive synthetic resin materials can contribute to enhance the production efficiency, in other words, to reduce the production cost as compared with the shaping air rings in the first to third embodiments.

Figure 9:
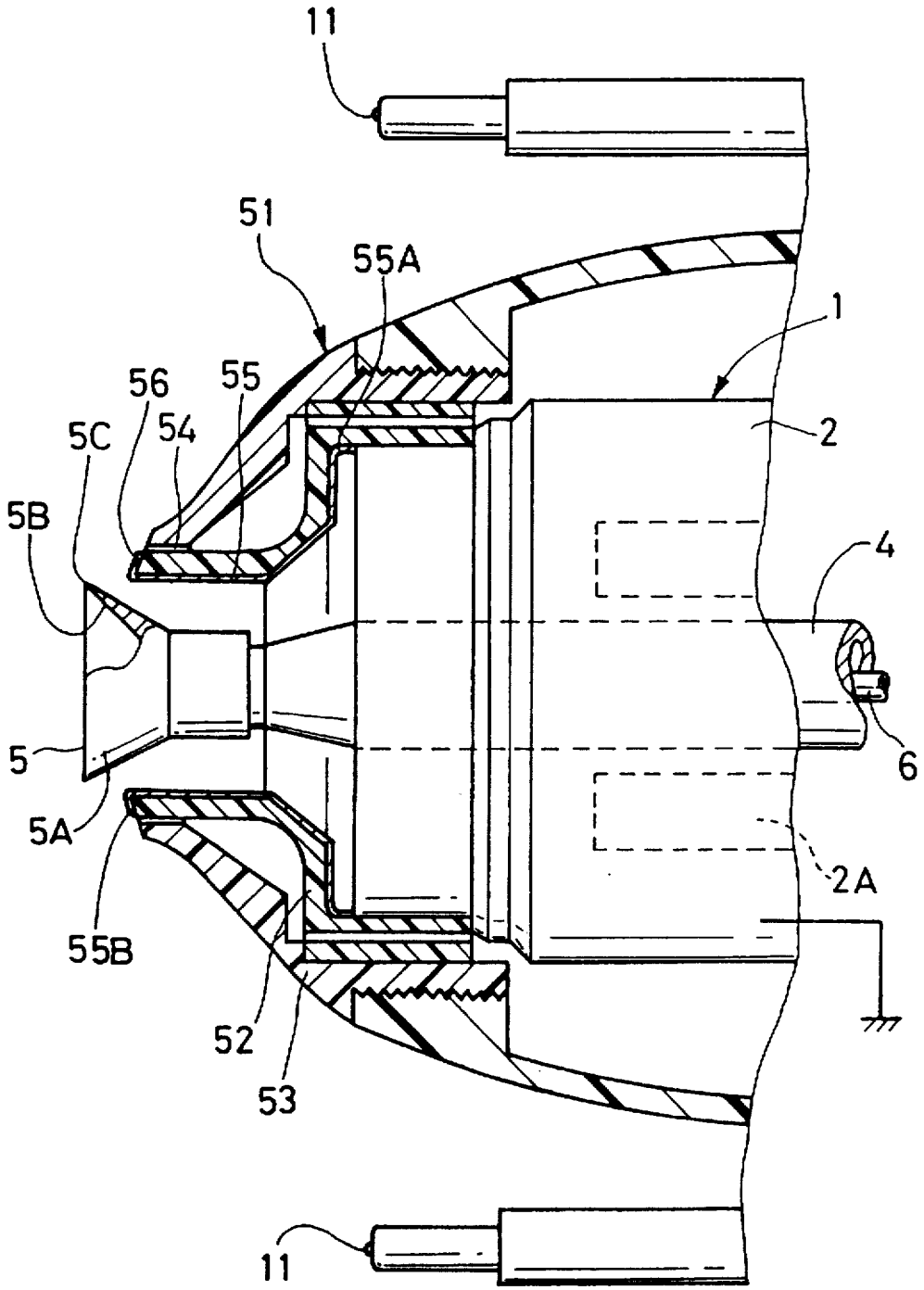
FIG. 9 is a vertical section through major components of a rotary atomizing head type coating machine adopted as a seventh embodiment of the invention.

Referring now to FIG. 9, there is shown a seventh embodiment of the invention, which is characterized in that the shaping air ring is constituted by a single member and provided with an annular repulsion electrode at the fore end of a conductive film layer formed on the inner periphery of the shaping air ring. In the following description of the seventh embodiment, those component parts common with the first embodiment are designated simply by common reference numerals or characters without repeating similar explanations.

In this figure, indicated at 51 is the shaping air ring constituted by an inner ring 52 which is formed of an insulating synthetic resin material similarly to the prior art shaping air ring 7 described hereinbefore, an outer ring 53 similarly formed of an insulating synthetic resin material in such a shape as to enshroud the outer periphery of the inner ring 52, and an annular air outlet 54 formed between the fore ends of the inner and outer rings 52 and 53 to spurt shaping air toward the outer periphery of the rotary atomizing head 5.

Denoted at 55 is a conductive film layer which is formed substantially fully around the inner periphery of the inner ring 52, for example, by application of a conductive paint or the like, and which has its base end portion 55A held in contact with and electrically connected to the outer periphery of the air motor 2. Fore end portion 55B of the conductive film layer 55 is extended onto the front end face of the inner ring 52 up to a point near the air outlet 54. As for the conductive film layer 55, there may be used, for example, a conductive paint kneaded with copper powder, aluminum powder, carbon, metal oxide or the like.

Indicated at 56 is an annular repulsion electrode which is provided at a fore end portion 55B of the above-described conductive film layer 55. The annular repulsion electrode 56 is formed integrally with the conductive film layer 55 in such a way as to circumvent the circumferential surfaces 5A of the rotary atomizing head 5 in the vicinity thereof.

This embodiment which is arranged in the manner just described can also produce substantially the same operational effects as in the foregoing embodiments in that negatively charged paint particles are securely prevented from depositing on the shaping air ring 51 by the phenomenon of homopolar repulsions of negative ion clouds occurring in the vicinity of the annular repulsion electrode 55.

Besides, by shaping air which is spurted out from the air outlet 54 of the shaping air ring 51, a large quantity of negative ions sucked inward toward the vicinity of the annular repulsion electrode 56, can be carried forward toward the outer periphery of the rotary atomizing head 5. Accordingly, paint particles released from the rotary atomizing head 5 are charged in a steady and assured manner by forwardly carried negative ions to enhance the paint deposition efficiency on a coating object.

Besides, according to the present embodiment, using the conductive film layer 55 which can be formed by coating a conductive paint on the inner ring 52, the film coating process as well as the fabrication process can be simplified, coupled with an advantage that electrical conductivity or resistance can be set at an arbitrary value according to the film thickness.

Figure 10:
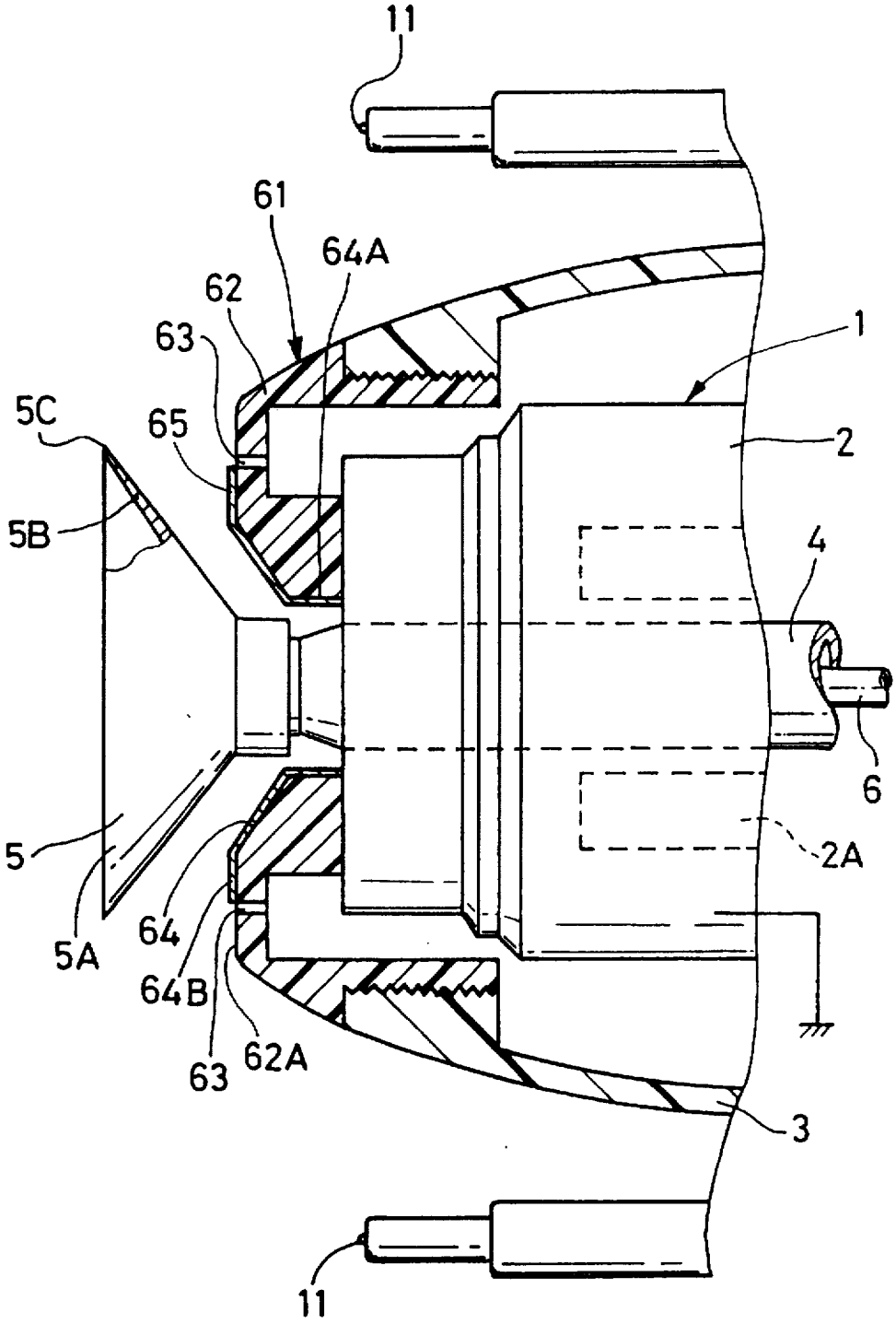
FIG. 10 is a vertical section through major components of a rotary atomizing head type coating machine adopted as an eighth embodiment of the invention.
Figure 11:
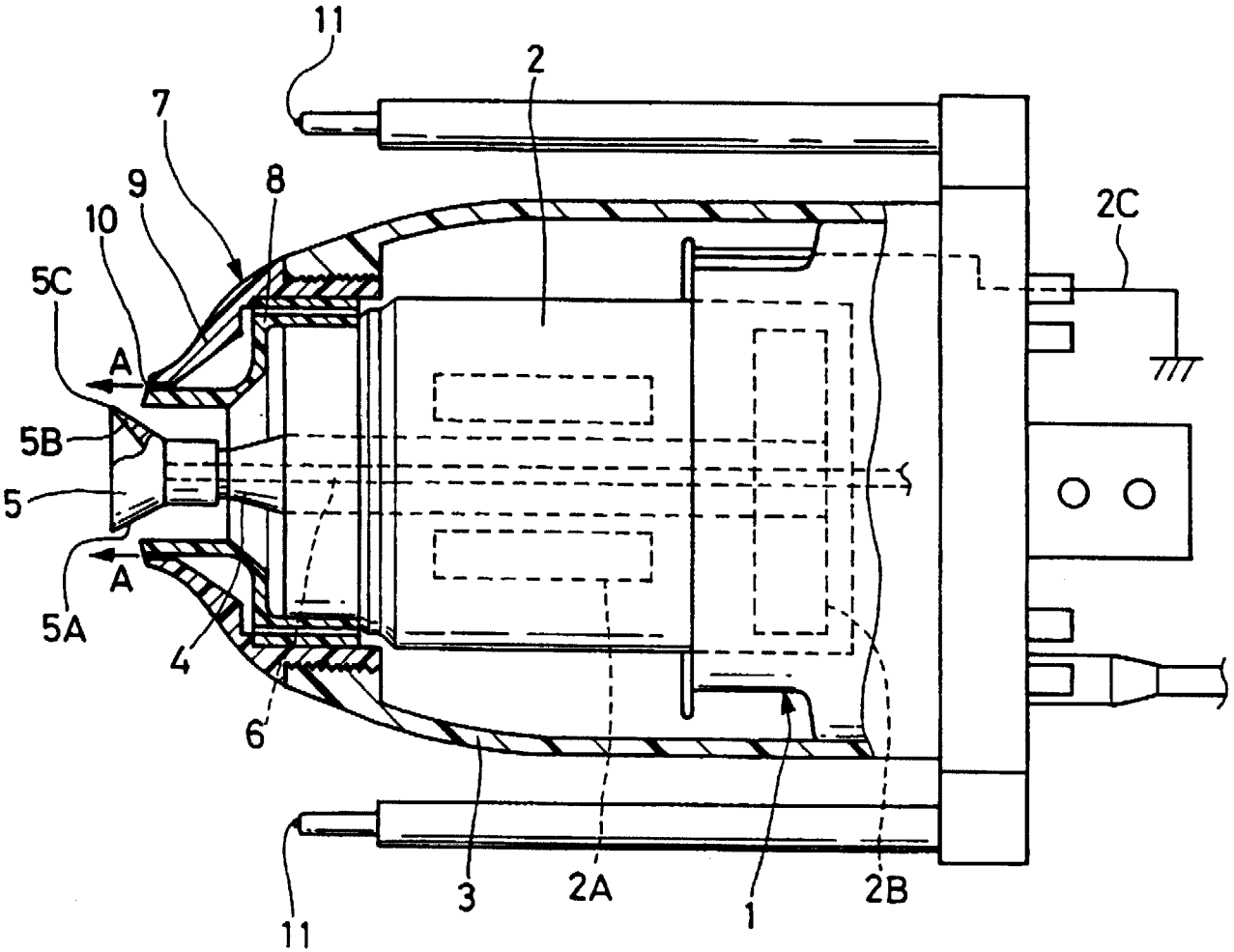
FIG. 11 is a vertical sectional view of a prior art rotary atomizing head type coating machine, showing its general construction.
Figure 12:
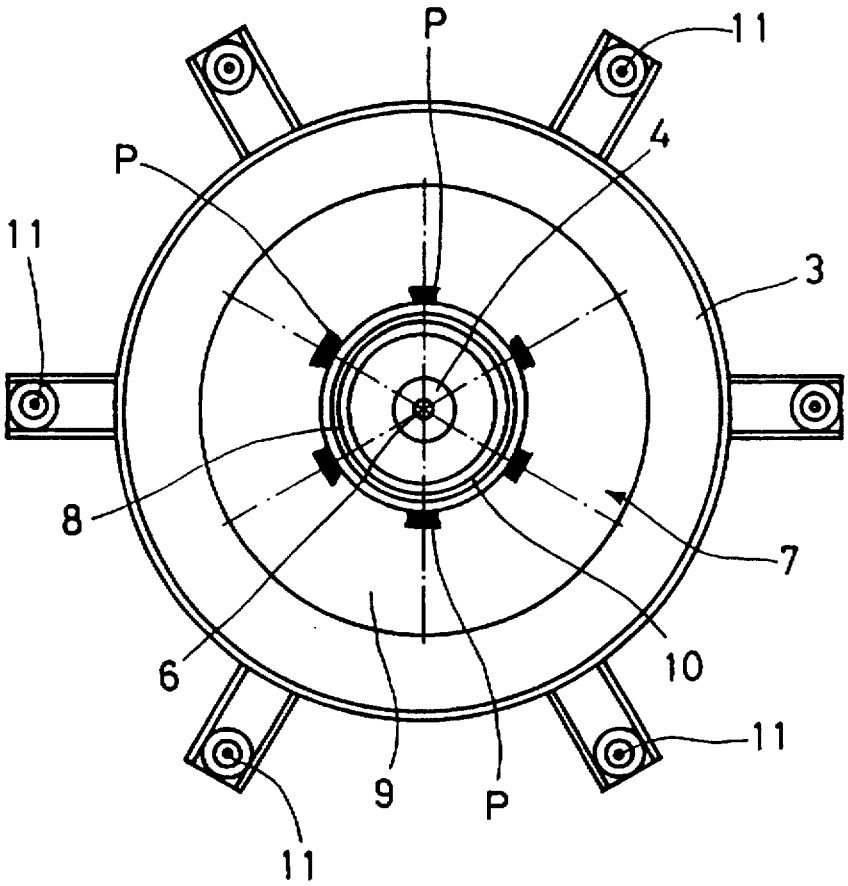
FIG. 12 is a schematic front view of the coating machine, with its rotary atomizing head assembly removed to show the degree of contamination occurring to its shaping air ring in five minutes of paint coating operation.
Figure 13:
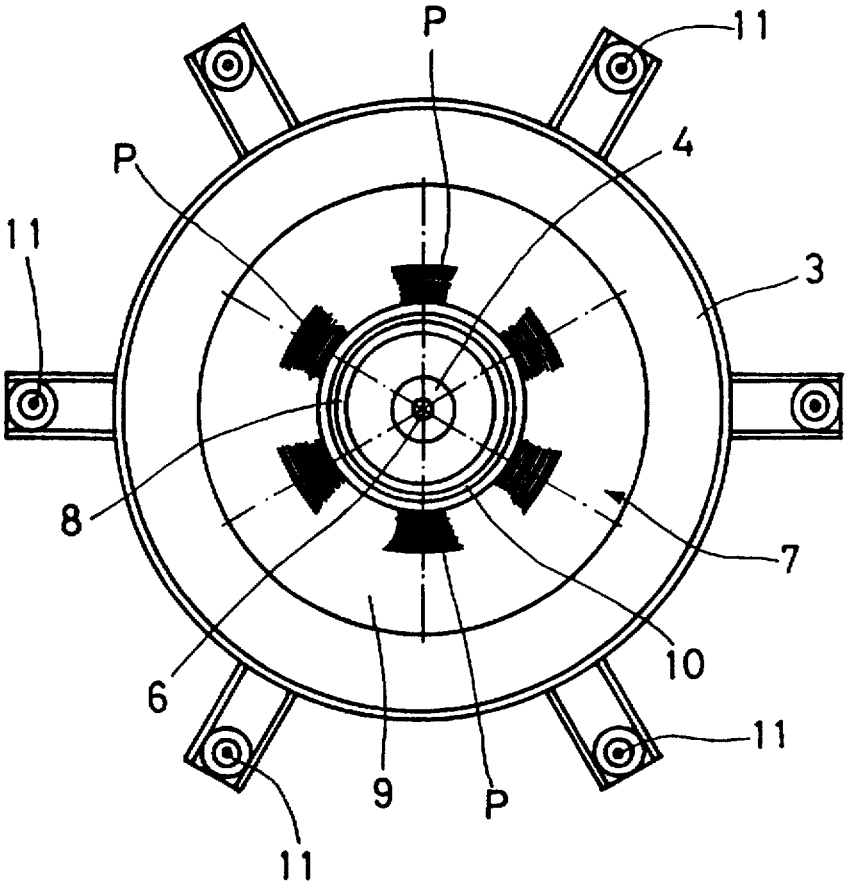
FIG. 13 is a schematic front view of the coating machine, with its rotary atomizing head assembly removed to show the degree of contamination occurring to its shaping air ring in 10 minutes of paint coating operation.
Figure 14:
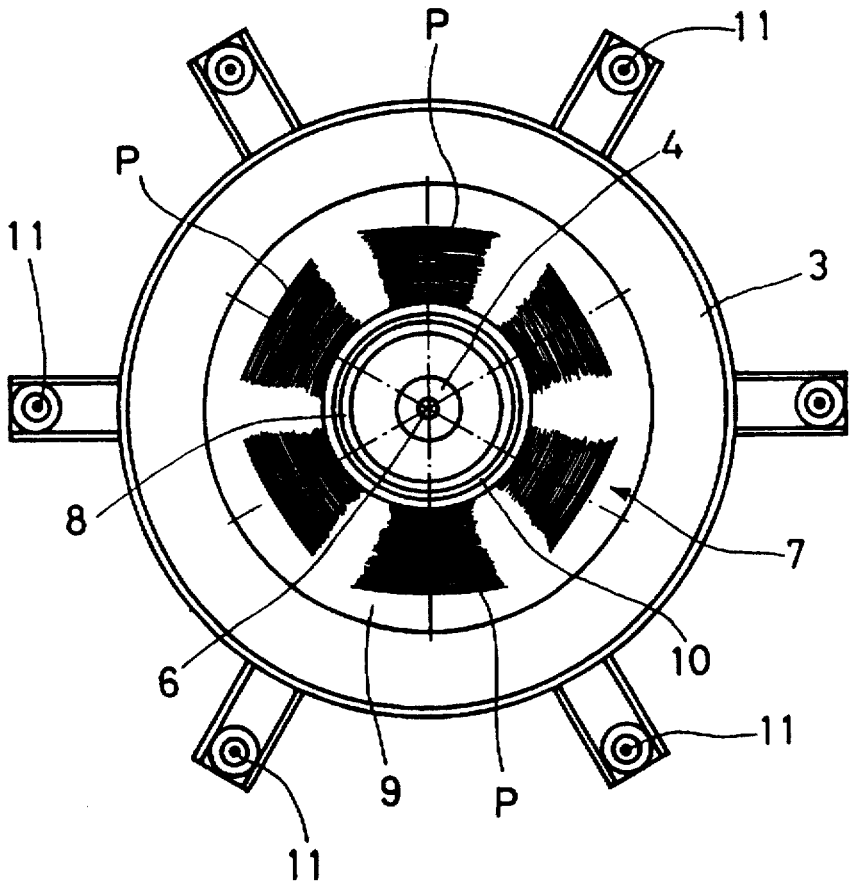
FIG. 14 is a schematic front view of the coating machine, with its rotary atomizing head assembly removed to show the degree of contamination occurring to its shaping air ring in 15 minutes of paint coating operation.

Shown in FIG. 10 is an eighth embodiment of the invention, which is characterized in that the shaping air ring is constituted by a single member, with a plural number of air outlets at its fore end, and in that an annular repulsion electrode is constituted by a fore end portion of a conductive film layer formed on its inner periphery. In the following description of the eighth embodiment, those component parts common with the foregoing first embodiment are simply designated by common reference numerals or characters without repeating similar explanations.

In this figure, indicated at 61 is the shaping air ring which is used in this embodiment. This shaping air ring 61 is threaded into a synthetic resin cover 3 at the fore end of the paint coating machine body 1, and located in a position behind the rotary atomizing head 5 in such a manner as to circumvent circumferential surfaces 5A of the rotary atomizing head 5.

In this instance, the shaping air ring 61 is constituted by a ring body proper 62 which is formed of an insulating synthetic resin material substantially in a J-shape in section with a front face 62A similarly to the counterparts in the foregoing embodiments, and a plural number of air outlet holes 63 which are arranged circularly on the front face 62A of the ring body 62 to spurt shaping air in a forward direction toward the outer periphery of the rotary atomizing head 5.

Indicated at 64 is a conductive film layer which is formed substantially fully around the inner periphery of the ring body 62, for example, by coating thereon a conductive paint or the like. The conductive film layer 64 is held in contact with and electrically connected with to outer periphery of the air motor 3 at its base end 64A, and has its fore end 64B extended forward as far as the front face 62A of the ring body 62.

Denoted at 65 is an annular repulsion electrode which is provided in a fore end portion 64B of the conductive film layer 64. This annular repulsion electrode 65 is formed integrally with the conductive film layer 64 as a ring-like body which circumvents the circumferential surfaces 5A of the rotary atomizing head 5 in the vicinity thereof.

With the arrangements just described, the present embodiment can also produce substantially the same operational effects as in each one of the foregoing embodiments of the present invention.

As described in detail hereinbefore, according to the present invention, at least part of the shaping air ring is formed of a conductive material to provide an annular repulsion electrode at least in part of the conductive material. By the provision of the annular repulsion electrode, positive discharges occur more strongly on the side of the annular repulsion electrode than on the side of the paint releasing edges. Clouds of negative ions generated by the external electrodes are therefore pulled toward the stronger positive discharges on the side of the shaping air ring, giving rise to the phenomenon of homopolar repulsion between negatively charged paint particles and clouds of negative ions, thereby preventing contamination of the shaping air ring by paint deposition in an assured manner.

In one particular form of the present invention, the shaping air ring is constituted by an inner ring formed of a conductive material and electrically connected to the air motor, an outer ring of an insulating synthetic resin material located to enshroud the outer periphery of the inner ring, an air outlet formed between the inner and outer rings, and an annular repulsion ring constituted by a fore end portion of the inner ring. In another form of the present invention, the shaping air ring is constituted by a ring body of an insulating synthetic resin material having an air outlets at the fore end thereof, a conductive ring of a conductive material provided on the inner periphery of the shaping air ring and electrically connected to the air motor, and an annular repulsion electrode constituted by a fore end portion of the conductive ring. As a result, in addition to the prevention of contamination of the shaping air ring, clouds of negative ions pulled toward the annular repulsion electrode are carried forward toward the outer periphery of the rotary atomizing head to charge to negative paint particles which are released from the paint releasing edges of the rotary atomizing head and therefore to enhancement of paint deposition efficiency on a coating object.

Further, according to the present invention, the shaping air ring may be constituted by a ring body of an insulating synthetic resin material having an air outlets on a flat front face thereof, a conductive ring of conductive material formed on the inner periphery of the shaping air ring and electrically connected to the air motor, and an annular repulsion electrode formed on the front face of the shaping air ring by a separate member from said conductive ring and electrically connected to the conductive ring. In this case, the annular repulsion electrode is provided with a broader surface area and capable of generating strong plasma discharges, thereby suppressing paint deposition on the air shaping ring all the more.

Furthermore, the annular repulsion electrode according to the present invention can be formed of either a conductive metallic material or a conductive synthetic resin material, so that a grater variety of materials can be used in the fabrication processes from the standpoint of attaining a higher production efficiency.

Alternatively, according to the present invention, the shaping air ring can be constituted by a ring body of an insulating synthetic resin material, a conductive film layer formed on the shaping air ring and electrically connected to the air motor, and an annular repulsion electrode constituted by at least part of the conductive film layer. In this case, in addition to the operational effects of preventing paint deposition on the shaping air ring by homopolar repulsions between negatively charged paint particles and clouds of negative ions occurring in the vicinity of the annular repulsion electrode, the use of the conductive film layer as an annular repulsion electrode contributes to facilitate the fabrication process of the shaping air ring.

Further, the use of the conductive film layer which can be formed simply by application of a conductive paint, makes easier the film forming process as well as the shaping air ring fabrication process, in addition to the advantage that the electrical conductivity or resistance of the film layer can be set at an arbitrary value according to the film thickness.

Furthermore, according to the present invention, the annular repulsion electrode which is provided as an annular ring-like body which circumvents circumferential surfaces of the rotary atomizing head at a position in the ambience of the latter, contributes to uniform and accelerated charging of paint particles which are released from the paint releasing edges of the rotary atomizing head.

We claim:

1. A rotary atomizing head type coating machine, including:

a coating machine body circumferentially enshrouded under a synthetic resin cover, an air motor provided within said coating machine body and grounded to earth potential, a rotary atomizing head provided at a fore end of said coating machine body and coupled with said air motor, said rotary atomizing head being terminated with paint releasing edges at a fore end thereof, a shaping air ring provided at the fore end of said coating machine body in such a way as to circumvent an outer periphery of said rotary atomizing head and having an air outlet to spurt shaping air from behind said paint releasing edges of said rotary atomizing head, external electrodes positioned radially on an outer side of said coating machine body and applied with a high voltage to charge paint particles sprayed from said paint releasing edges of said rotary atomizing head, at least part of said shaping air ring being formed of a conductive material and electrically connected to said air motor, and an annular repulsion electrode formed at least in part of said conductive material.

2. A rotary atomizing head type coating machine according to claim 1, wherein said shaping air ring is constituted by an inner ring formed of a conductive material and electrically connected to said air motor, an outer ring formed of an insulating synthetic resin material and positioned in such a way as to enshroud the outer periphery of said inner ring, and an air outlet formed between said inner and outer rings, and said annular repulsion electrode is constituted by a fore end portion of said inner ring.

3. A rotary atomizing head type coating machine as defined in claim 2, wherein said conductive material constituting said annular repulsion electrode is a conductive metallic material.

4. A rotary atomizing head type coating machine as defined in claim 2, wherein said conductive material constituting said annular repulsion electrode is a conductive synthetic resin material.

5. A rotary atomizing head type coating machine as defined in claim 2, wherein said annular repulsion electrode is in the form of an annular ring-like body circumventing circumferential surfaces of said rotary atomizing head in the vicinity thereof.

6. A rotary atomizing head type coating machine according to claim 1, wherein said shaping air ring is constituted by a ring body formed of an insulating synthetic resin material and having an air outlet at the fore end thereof, a conductive ring formed on the inner periphery of said shaping air ring by the use of a conductive material and electrically connected to said air motor, and said annular repulsion electrode is constituted by a fore end portion of said conductive ring.

7. A rotary atomizing head type coating machine as defined in claim 6, wherein said conductive material constituting said annular repulsion electrode is a conductive metallic material.

8. A rotary atomizing head type coating machine as defined in claim 6, wherein said conductive material constituting said annular repulsion electrode is a conductive synthetic resin material.

9. A rotary atomizing head type coating machine as defined in claim 6, wherein said annular repulsion electrode is in the form of an annular ring-like body circumventing circumferential surfaces of said rotary atomizing head in the vicinity thereof.

10. A rotary atomizing head type coating machine according to claim 1, wherein said shaping air ring is constituted by a ring body formed of an insulating synthetic resin material and having an air outlet on a flat front face thereof, a conductive ring formed on the inner periphery of said shaping air ring body by the use of a conductive material and electrically connected to said air motor, and said annular repulsion electrode is formed on the front face of said shaping air ring by a separate member from said conductive ring and electrically connected to said conductive ring.

11. A rotary atomizing head type coating machine as defined in claim 10, wherein said annular repulsion electrode is in the form of an annular ring-like body circumventing circumferential surfaces of said rotary atomizing head in the vicinity thereof.

12. A rotary atomizing head type coating machine as defined in claim 1, wherein said conductive material constituting said annular repulsion electrode is a conductive metallic material.

13. A rotary atomizing head type coating machine as defined in claim 1, wherein said conductive material constituting said annular repulsion electrode is a conductive synthetic resin material.

14. A rotary atomizing head type coating machine as defined in claim 1, wherein said annular repulsion electrode is in the form of an annular ring-like body circumventing circumferential surfaces of said rotary atomizing head in the vicinity thereof.

15. A rotary atomizing head type coating machine, including:

a coating machine body circumferentially enshrouded under a synthetic resin cover, an air motor provided within said coating machine body and grounded to earth potential, a rotary atomizing head provided at a fore end of said coating machine body and coupled with said air motor, said rotary atomizing head being terminated with paint releasing edges at a fore end thereof, a shaping air ring provided at the fore end of said coating machine body in such a way as to circumvent the outer periphery of said rotary atomizing head and having an outlet to spurt shaping air from behind said paint releasing edges of said rotary atomizing head, external electrodes positioned radially on an outer side of said coating machine body and externally applied with a high voltage to charge paint particles sprayed from said paint releasing edges of said rotary atomizing head, said shaping air ring being formed of an insulating synthetic resin material, and provided with a conductive film layer formed on an inner periphery thereof and electrically connected to said air motor, and an annular repulsion electrode constituted by at least part of said conductive film layer.

16. A rotary atomizing head type coating machine as defined in claim 15, wherein said shaping air ring is constituted by an inner ring formed of an insulating synthetic resin material, an outer ring formed of an insulating synthetic resin material and positioned in such a way as to circumvent the outer periphery of said inner ring, an air outlet formed between said inner and outer rings, a conductive film layer formed by coating the inner periphery of said inner ring with a conductive paint, and said annular repulsion electrode is constituted by a fore end portion of said conductive film layer.

17. A rotary atomizing head type coating machine as defined in claim 16, wherein said annular repulsion electrode is in the form of an annular ring-like body circumventing circumferential surfaces of said rotary atomizing head in the vicinity thereof.

18. A rotary atomizing head type coating machine as defined in claim 15, wherein said shaping air ring is constituted by a ring body formed of an insulating synthetic resin material and having air outlets on a flat front face thereof, a conductive film layer compressing a conductive paint coated on the inner periphery and extending to said flat front face of said shaping air ring body, and an annular repulsion electrode constituted by a fore end portion of said conductive film layer.

19. A rotary atomizing head type coating machine as defined in claim 18, wherein said annular repulsion electrode is in the form of an annular ring-like body circumventing circumferential surfaces of said rotary atomizing head in the vicinity thereof.

20. A rotary atomizing head type coating machine as defined in claim 15, wherein said annular repulsion electrode is in the form of an annular ring-like body circumventing circumferential surfaces of said rotary atomizing head in the vicinity thereof.

* * * * *